US012781653B2

(12) United States Patent
Borla

(10) Patent No.: US 12,781,653 B2
(45) Date of Patent: Nov. 3, 2026

(54) EXHAUST MUFFLER FOR INTERNAL COMBUSTION ENGINES

(71) Applicant: David Akiba Borla, Thousand Oaks, CA (US)

(72) Inventor: David Akiba Borla, Thousand Oaks, CA (US)

( * ) Notice: Subject to any disclaimer, the term of this patent is extended or adjusted under 35 U.S.C. 154(b) by 193 days.

(21) Appl. No.: 18/406,324

(22) Filed: Jan. 8, 2024

(65) Prior Publication Data

US 2024/0229693 A1 Jul. 11, 2024

Related U.S. Application Data

(60) Provisional application No. 63/478,755, filed on Jan. 6, 2023.

(51) Int. Cl.
*F01N 1/04* (2006.01)
*F01N 1/24* (2006.01)
*F01N 13/08* (2010.01)

(52) U.S. Cl.
CPC ..... *F01N 1/24* (2013.01); *F01N 2310/02* (2013.01); *F01N 2310/04* (2013.01); *F01N 2470/02* (2013.01)

(58) Field of Classification Search
CPC . F01N 1/24; F01N 1/003; F01N 1/006; F01N 1/04; F01N 13/08; F01N 2310/00; F01N 2310/02; F01N 2310/04; F01N 2470/00; F01N 2470/02; F01N 2470/08; F01N 2470/14; F01N 2470/16; F01N 2470/24
See application file for complete search history.

(56) References Cited

U.S. PATENT DOCUMENTS 2,019,697 A * 11/1935 Smith ..... F01N 13/20 181/251
2,292,340 A 8/1942 Mccurdy
2,624,418 A * 1/1953 Bourne ..... F01N 1/089 181/251

(Continued)

FOREIGN PATENT DOCUMENTS

DE 202011052417 U1 * 2/2012 ..... F01N 13/08

OTHER PUBLICATIONS

International Search Report and Written Opinion issued by WIPO mailed on Mar. 29, 2024 (.

*Primary Examiner* — Edgardo San Martin
(74) *Attorney, Agent, or Firm* — Robinson IP Law, PLLC

(57) ABSTRACT

Various implementations include a muffler including a shell and a tube assembly. The shell defines a shell cavity and has a shell longitudinal axis, a shell first end, and a shell second end. The shell first end and the shell second end each define a shell opening extending to the shell cavity. The tube assembly is disposed within the shell cavity. The tube assembly includes three or more nested tubes. Each of the three or more nested tubes has a tube longitudinal axis parallel to the shell longitudinal axis, a tube first end, and a tube second end. Each of the three or more nested tubes defines a plurality of perforations. The three or more nested tubes are disposed circumferentially adjacent each other around the shell longitudinal axis such that portions of sides of the three or more nested tubes form an open portion extending along the shell longitudinal axis.

20 Claims, 15 Drawing Sheets

(56) References Cited

U.S. PATENT DOCUMENTS

| | | | | | |
|---|---|---|---|---|---|
| 2,998,860 | A * | 9/1961 | Everett | B24D 5/04 | 181/257 |
| 4,108,276 | A * | 8/1978 | Hall | F01N 1/10 | 181/256 |
| 4,234,054 | A * | 11/1980 | Chapin | F01N 1/24 | 181/252 |
| 4,605,092 | A * | 8/1986 | Harris | F01N 1/06 | 181/268 |
| 4,712,644 | A * | 12/1987 | Sun | F01N 1/24 | 181/251 |
| 5,198,625 | A | 3/1993 | Borla | | |
| 5,248,859 | A * | 9/1993 | Borla | F01N 13/08 | 181/251 |
| 8,042,649 | B2 | 10/2011 | Inoue | | |
| 8,196,703 | B2 * | 6/2012 | Stanley | F01N 1/006 | 181/232 |
| 8,439,159 | B1 | 5/2013 | Borla | | |
| 8,468,812 | B1 * | 6/2013 | Banks, III | F01N 13/08 | 60/323 |
| 9,638,087 | B2 | 5/2017 | Kim | | |
| 9,816,412 | B1 * | 11/2017 | Strickland, Jr. | F01N 1/24 | |
| 10,808,584 | B2 * | 10/2020 | Borla | F01N 1/02 | |
| 11,661,870 | B2 * | 5/2023 | Borla | F01N 1/02 | 181/228 |
| D1,035,523 | S * | 7/2024 | Borla | D12/194 | |

* cited by examiner

EXHAUST MUFFLER FOR INTERNAL COMBUSTION ENGINES

FIELD

This disclosure relates to the field of attenuating a sound of exhaust flow from an internal combustion engine. More particularly, this disclosure relates to mufflers for use with internal combustion engines and the like.

BACKGROUND

Problems related to muffling the noise generated or emitted in exhaust gases from internal combustion engines is well known. Many types of mufflers and noise reduction devices have been developed to address these problems. One type of muffler is generally referred to as an absorption muffler that directs gas straight through a perforated tube with a uniform configuration from end to end with sound deadening material such as glass fibers between the tube and an outer housing. These mufflers typically provide lower back pressure but may not be effective in reducing the level of noise from the muffler.

Another type of muffler is a resonator-type muffler. A resonator-type muffler typically uses a series of baffle plates to change the path of the exhaust gases. By interrupting or changing the direction of gas flow, sound frequencies passing therethrough are reflected back toward the noise source by the baffle plates thus mechanically canceling each other where they meet. This type of muffler may reduce noise to some extent. However, the partially blocked exhaust flow may increase back pressure of the exhaust.

Examples of other mufflers include those described in U.S. Pat. Nos. 5,198,625 and 8,439,159. These mufflers may provide reduced back pressure and reduced noise levels. However, in high performance applications, such as racing applications, it may be desirable to further lower back pressure and reduce noise level.

What is needed, therefore, is a muffler that further reduces noise level and backpressure in an exhaust system, that is adapted for use with automotive racing for sustained periods, and that is packaged for use with under-vehicle mounting on racing and high-performance vehicles.

SUMMARY

Some aspects described herein relate to a muffler including: a shell; a tube assembly located within the shell, the tube assembly having a first collar having an opening on a first end and a plurality of lobes on a second end, a second collar having a plurality of lobes on a first end and an opening on a second end, and a plurality of nested tubes located between the plurality of lobes of the first collar and the plurality of lobes of the second collar, wherein the plurality of nested tubes are perforated; an open portion located at a center of the tube assembly, the open portion having a shape defined by sides of the plurality of nested tubes, the open portion aligned with a center of the tube assembly.

Various implementations include a muffler. The muffler includes a shell and a tube assembly. The shell defines a shell cavity. The shell has a shell longitudinal axis, a shell first end, and a shell second end opposite and spaced apart along the shell longitudinal axis from the shell first end. The shell first end and the shell second end each define a shell opening extending to the shell cavity. The tube assembly is disposed within the shell cavity. The tube assembly includes three or more nested tubes. Each of the three or more nested tubes has a tube longitudinal axis parallel to the shell longitudinal axis, a tube first end, and a tube second end opposite and spaced apart along the tube longitudinal axis from the tube first end. Each of the three or more nested tubes defines a plurality of perforations. The three or more nested tubes are disposed circumferentially adjacent each other around the shell longitudinal axis such that portions of sides of the three or more nested tubes form an open portion extending along the shell longitudinal axis.

In some implementations, the tube assembly further includes a first collar and a second collar each defining a collar longitudinal axis, a collar first end, and a collar second end opposite and spaced apart along the collar longitudinal axis from the collar first end. In some implementations, the collar first end defines a collar opening extending to the collar second end. In some implementations, the tube first end of each of the three or more nested tubes are disposed within the collar second end of the first collar, and the tube second end of each of the three or more nested tubes are disposed within the collar second end of the second collar.

In some implementations, the collar opening of the collar first end has a first cross-sectional area as viewed in a plane perpendicular to the collar longitudinal axis, and the collar opening of the collar second end has a second cross-sectional area as viewed in a plane perpendicular to the collar longitudinal axis. In some implementations, the second cross-sectional area is greater than the first cross-sectional area.

In some implementations, the collar first end has a cylindrical shape.

In some implementations, the collar opening of the collar second end of the first collar and the second collar defines three or more lobes having an arcuate cross section as viewed in a place perpendicular to the collar longitudinal axis. In some implementations, each of the three or more nested tubes is disposed within a different one of the three or more lobes. In some implementations, the three or more lobes each have a radius of curvature corresponding to a radius of curvature of one of the three or more nested tubes.

In some implementations, the muffler further includes a first end cap and a second end cap. In some implementations, each of the first end cap and the second end cap defines an end cap opening. In some implementations, the first end cap is disposed within the shell opening of the shell first end, and the second end cap is disposed within the shell opening of the shell second end. In some implementations, the first collar end of the first collar is disposed within the end cap opening of the first end cap, and the first collar end of the second collar is disposed within the end cap opening of the second end cap.

In some implementations, the end cap opening defines a flange extending axially relative to the shell longitudinal axis. In some implementations, flange of the end cap opening is configured to be couplable to one of an inlet duct or an outlet duct of an exhaust system.

In some implementations, the three or more nested tubes comprises five or more nested tubes. In some implementations, the five or more nested tubes comprises six or more nested tubes.

In some implementations, each of the three or more nested tubes has an outer surface. In some implementations, the plurality of perforations are located on a portion of the outer surface covering 5% to 80% of each of the three or more nested tubes. In some implementations, the portion of the outer surface covers 20% to 40% of each of the three or more nested tubes. In some implementations, the plurality of perforations are located on a portion of the outer surface covering 100% of each of the three or more nested tubes.

In some implementations, the shell has an oval cross-sectional shape as viewed in a plane perpendicular to the shell longitudinal axis.

In some implementations, the muffler further includes a sound attenuating material disposed within the shell cavity between the three or more nested tubes and the shell. In some implementations, the sound attenuating material includes steel wool. In some implementations, the sound attenuating material includes fiberglass. In some implementations, the sound attenuating material includes ceramic fiber.

BRIEF DESCRIPTION OF DRAWINGS

Example features and implementations of the present disclosure are disclosed in the accompanying drawings. However, the present disclosure is not limited to the precise arrangements and instrumentalities shown. Similar elements in different implementations are designated using the same reference numerals.

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1A:
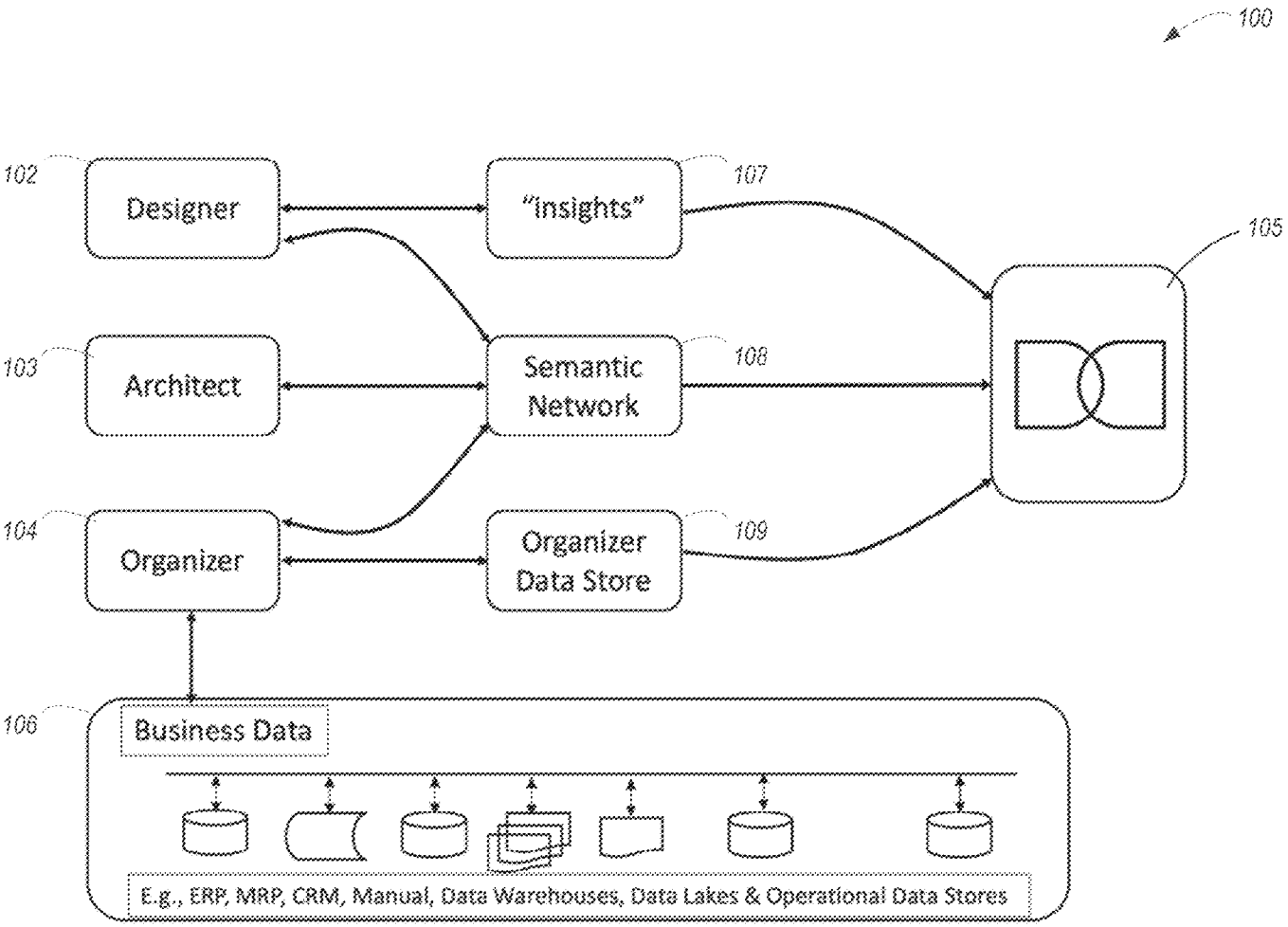
FIG. 1 shows a perspective view of a muffler according to one aspect of the present disclosure.
Figure 1B:
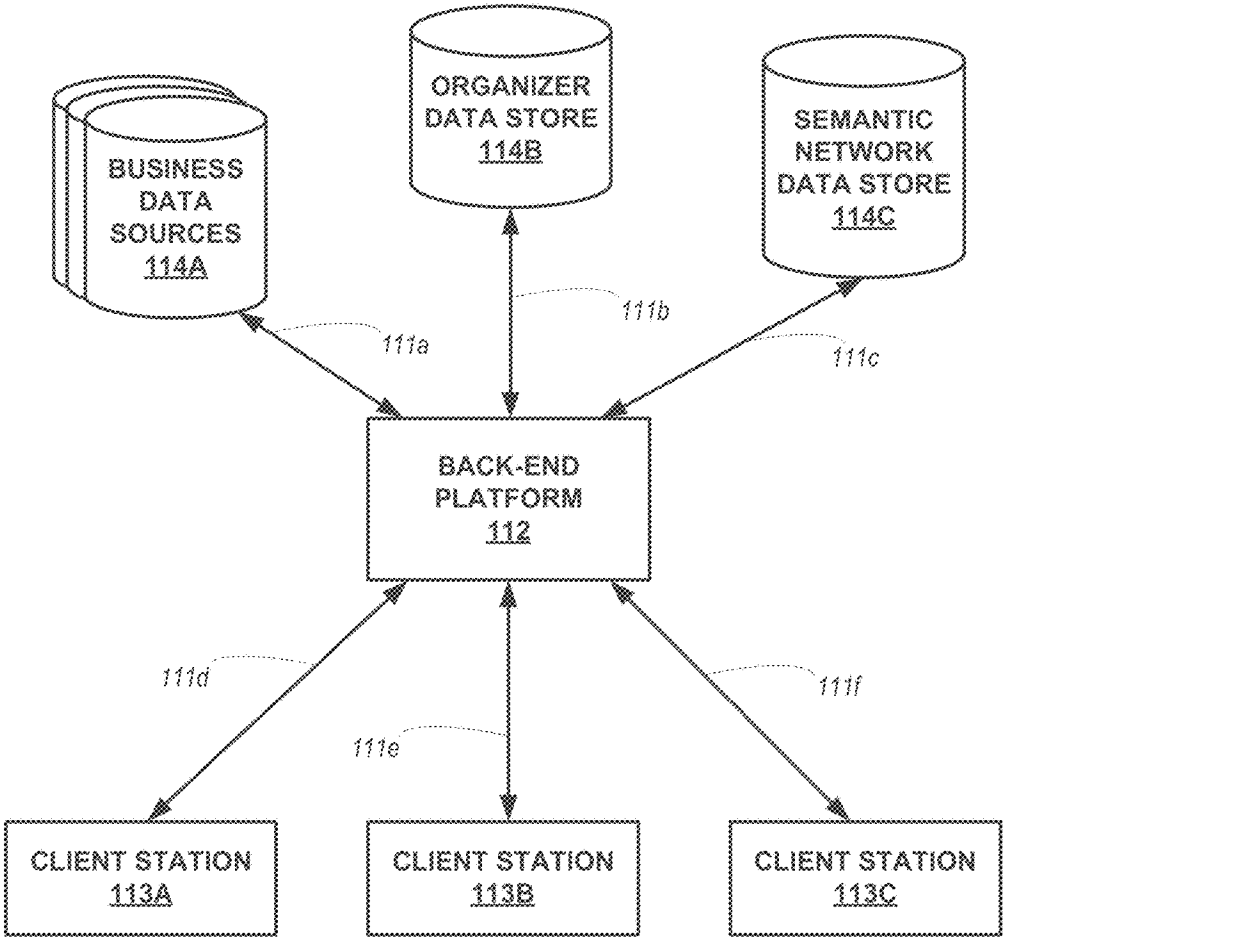

FIG. 1 shows an aspect of a muffler 10 that may be adapted for use with internal combustion engines. The muffler 10 is configured such that the muffler 10 may attenuate, alter, or reduce sound of an internal combustion engine created by high velocity air or gas flowing through the muffler 10. The muffler 10 may be suitable for installation on a vehicle, such as a high-performance vehicle or racing vehicle.

The muffler 10 includes a shell 12 defining a shell cavity 13. The shell 12 has a shell longitudinal axis 15, a shell first end 52, and a shell second end 54 opposite and spaced apart along the shell longitudinal axis 15 from the shell first end 52. The shell first end 52 and the shell second end 54 each define a shell opening 56 extending to the shell cavity 13. The shell 12 is formed as a cylinder and may have a cross-section such that the shell 12 forms an elliptical or oval-shaped cylinder, as shown in FIG. 1. The shell 12 may be formed of a sheet of material, such as stainless steel, and joined at a seam weld 14.

Figure 2:
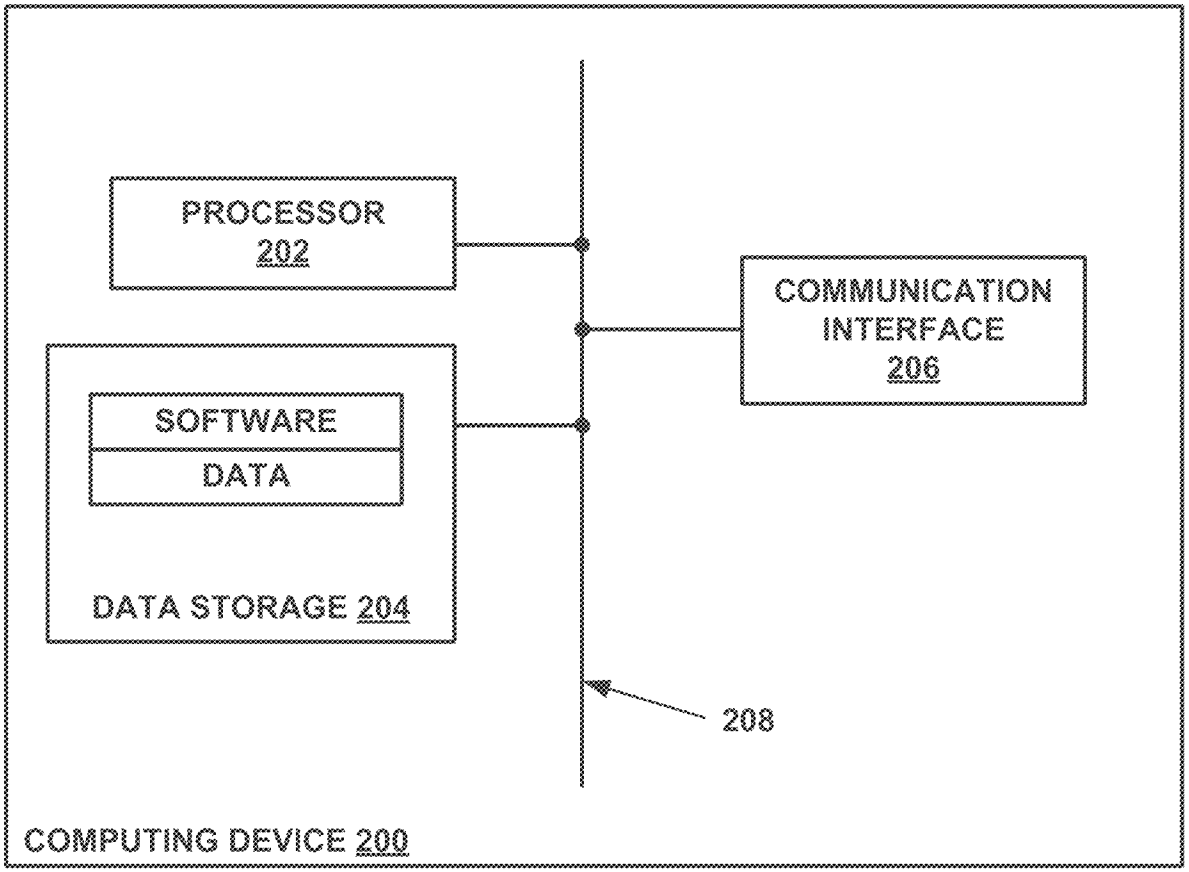
FIG. 2 shows a cross-sectional side view of a muffler according to one aspect of the present disclosure.
Figure 3:
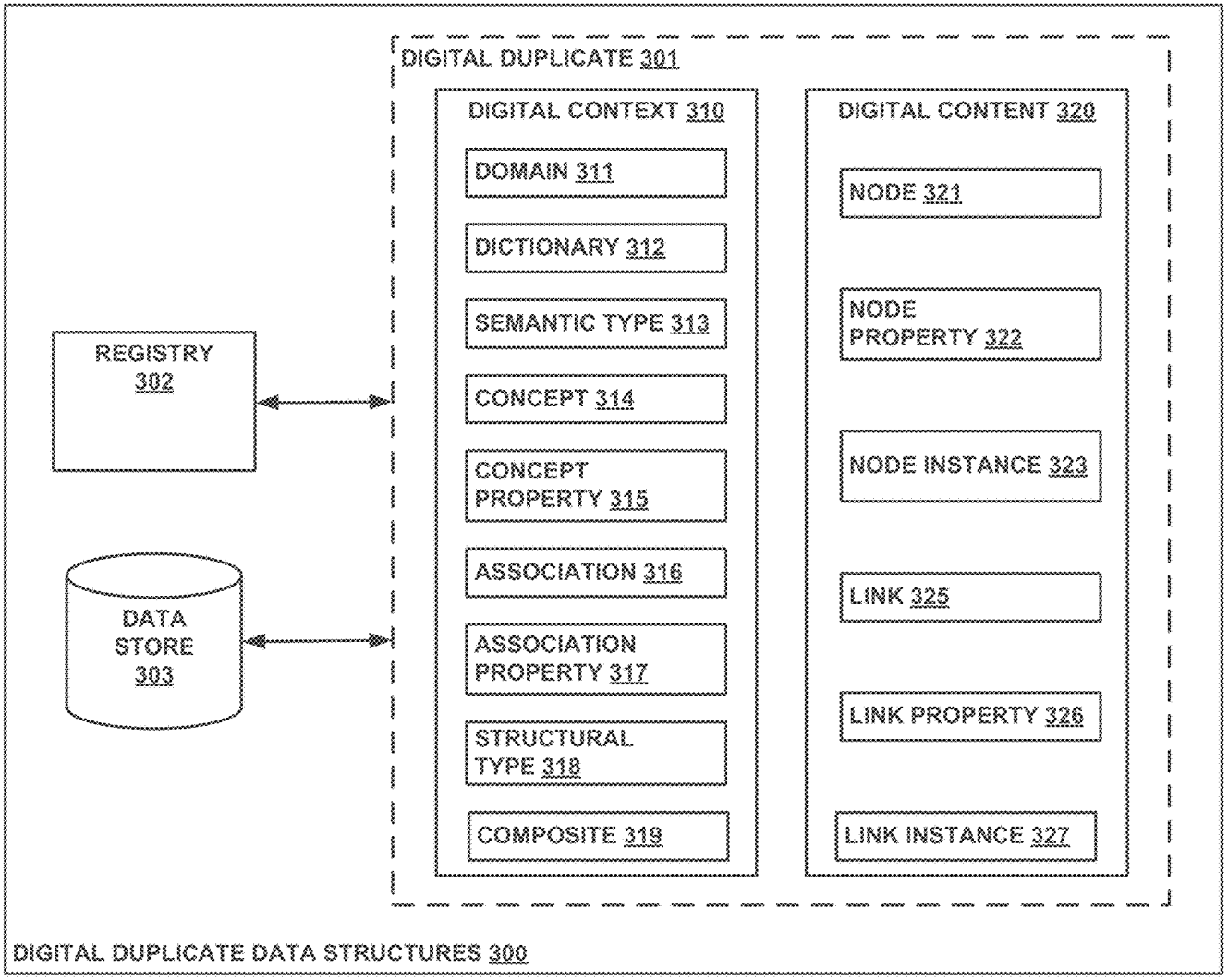
FIG. 3 shows an end view of a muffler according to one aspect of the present disclosure.
Figure 7:
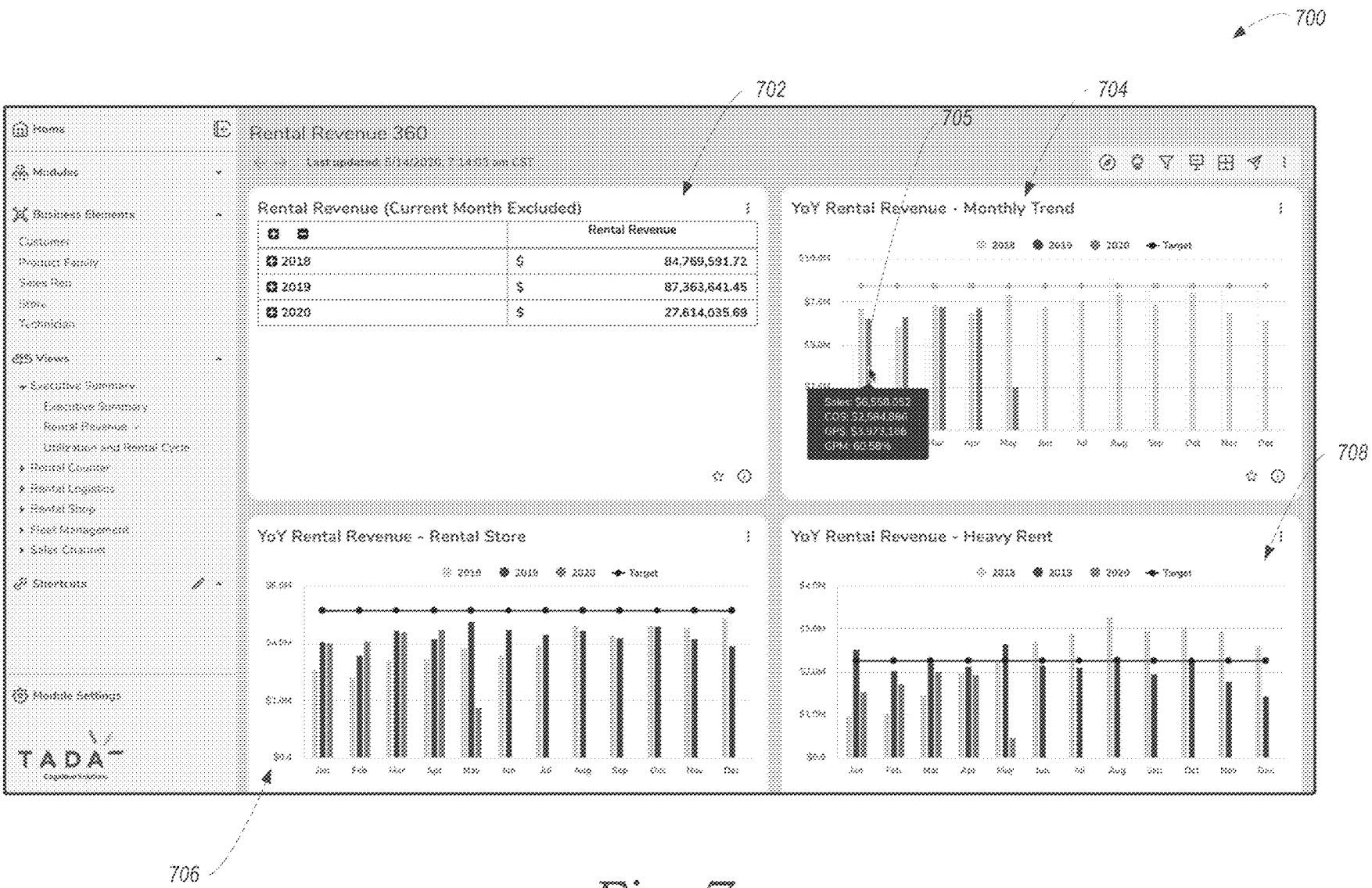
FIG. 7 shows an exhaust system including a muffler according to one aspect of the present disclosure.
Figure 8:
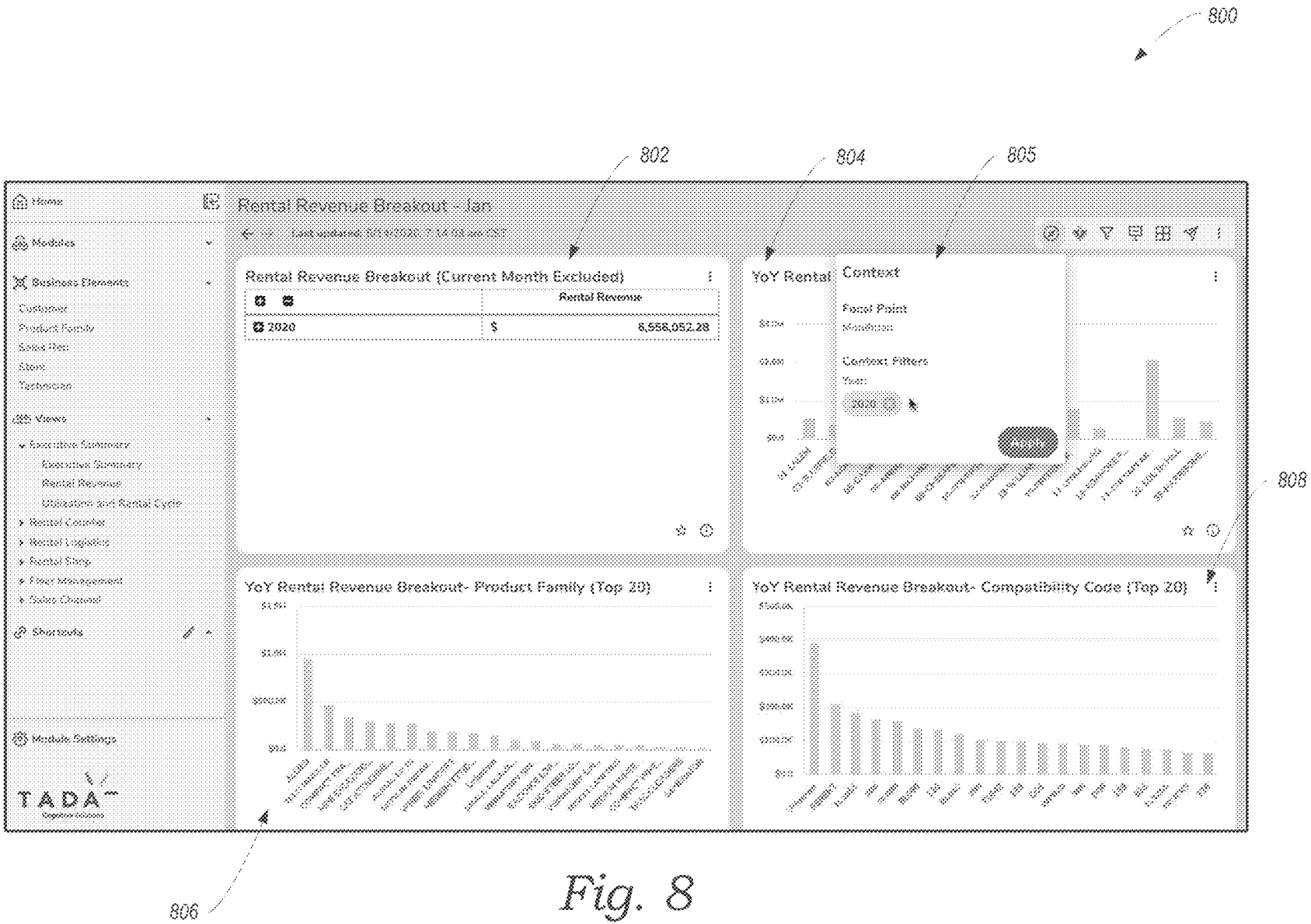
Figure 9A:
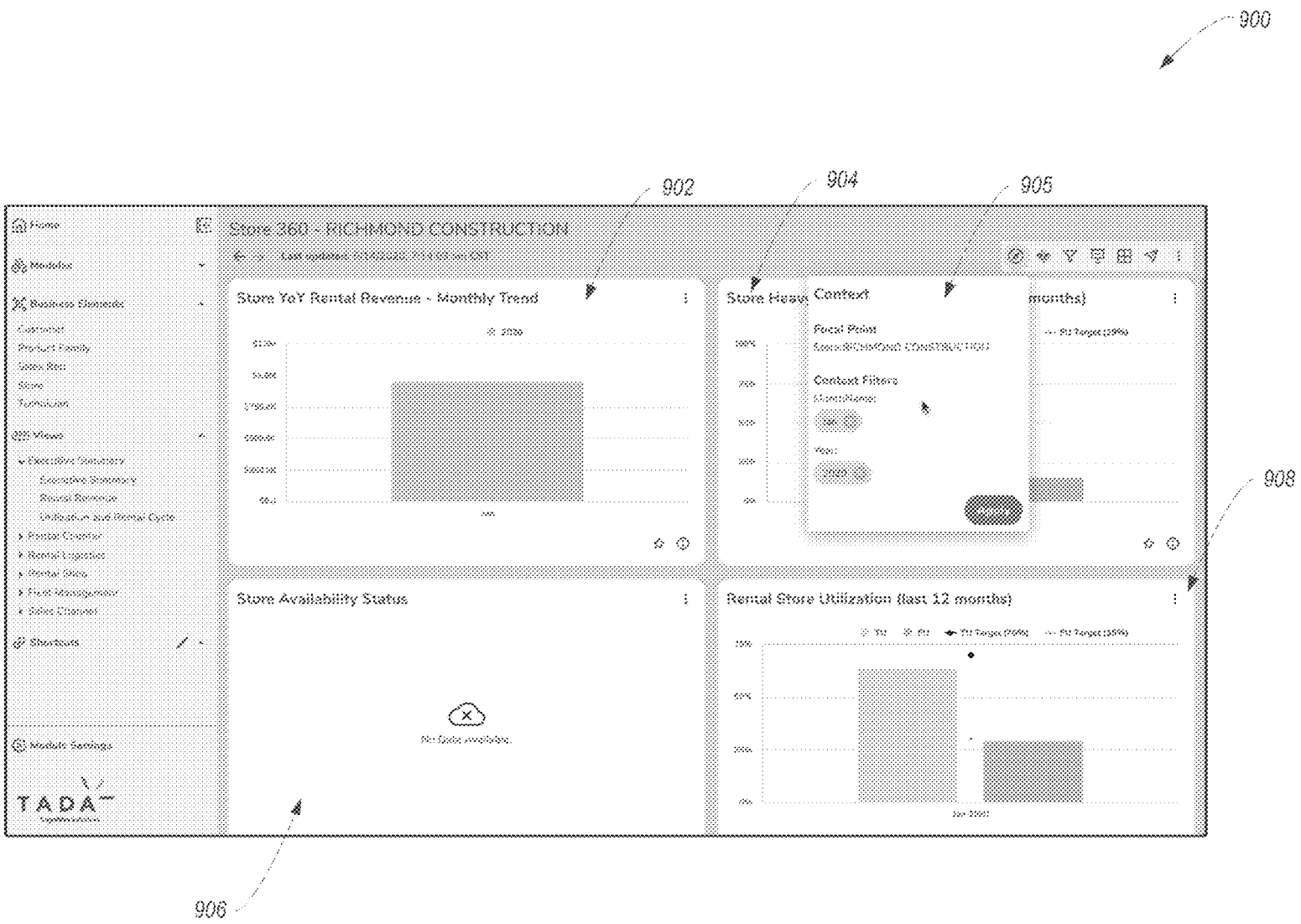
Figure 9B:
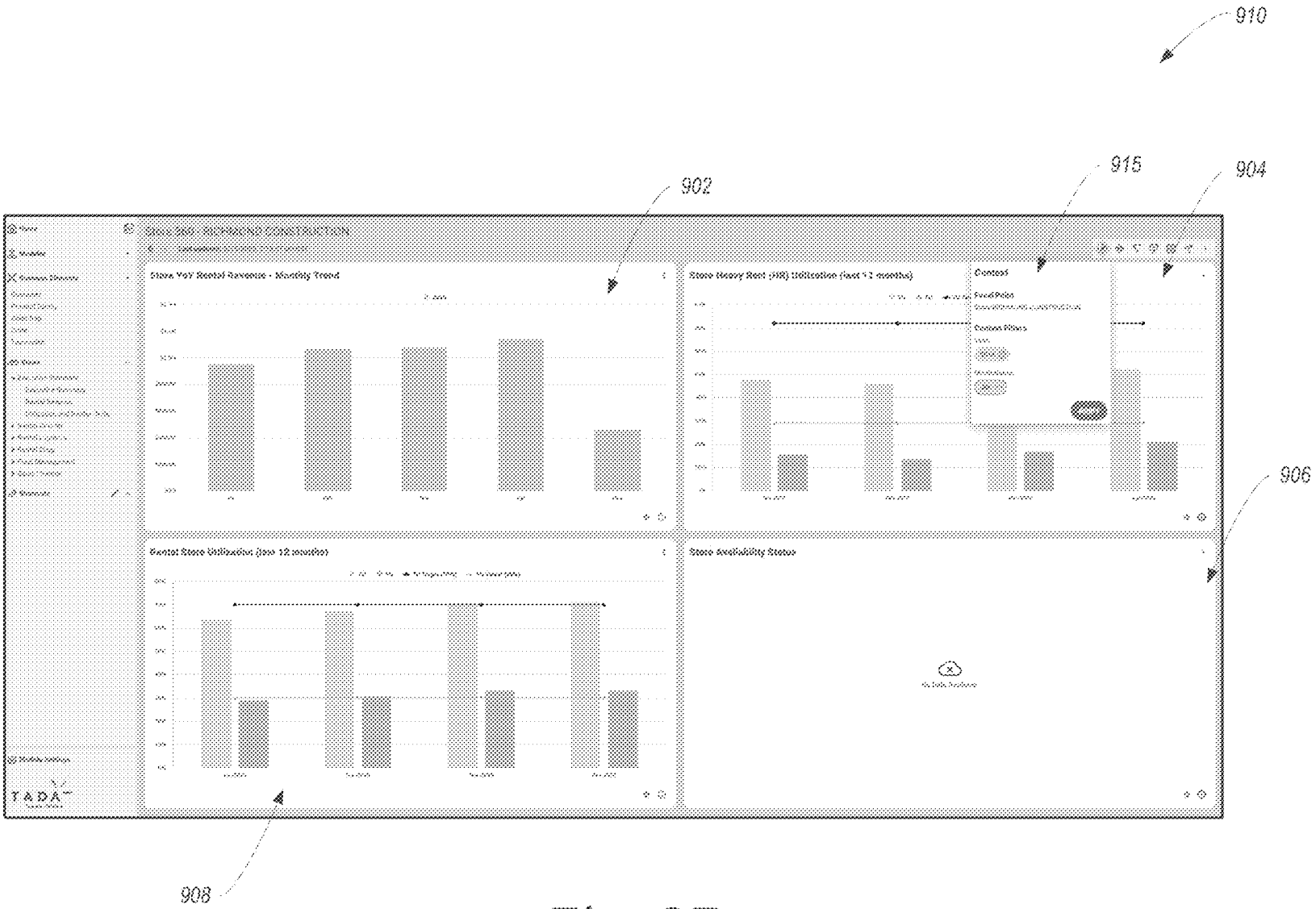
Figure 10A:
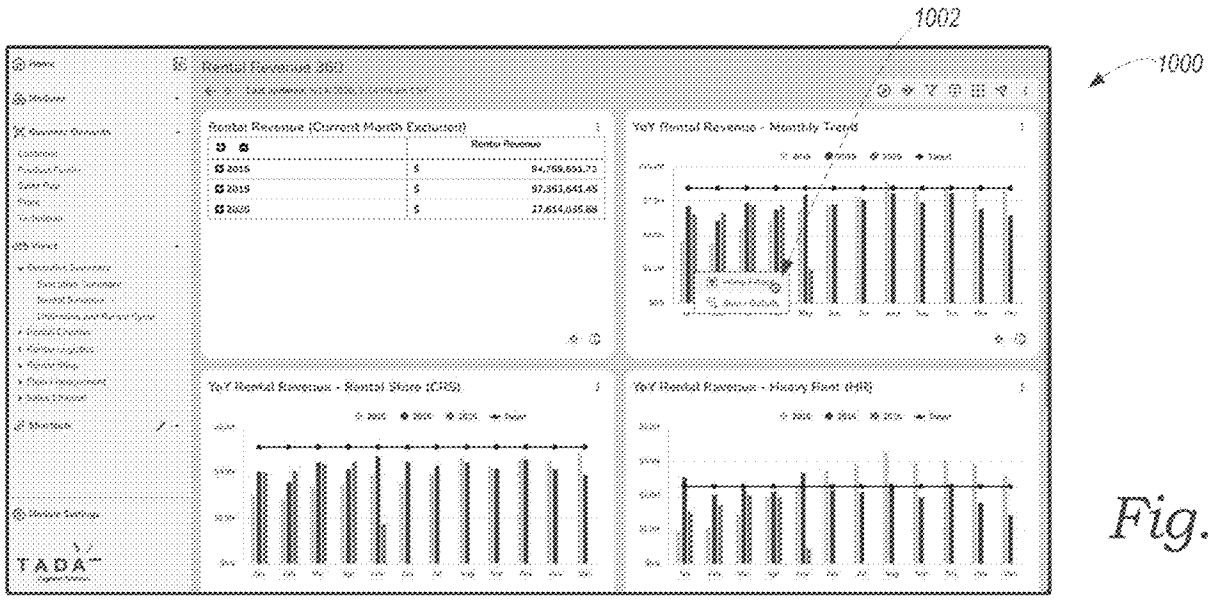
Figure 10B:
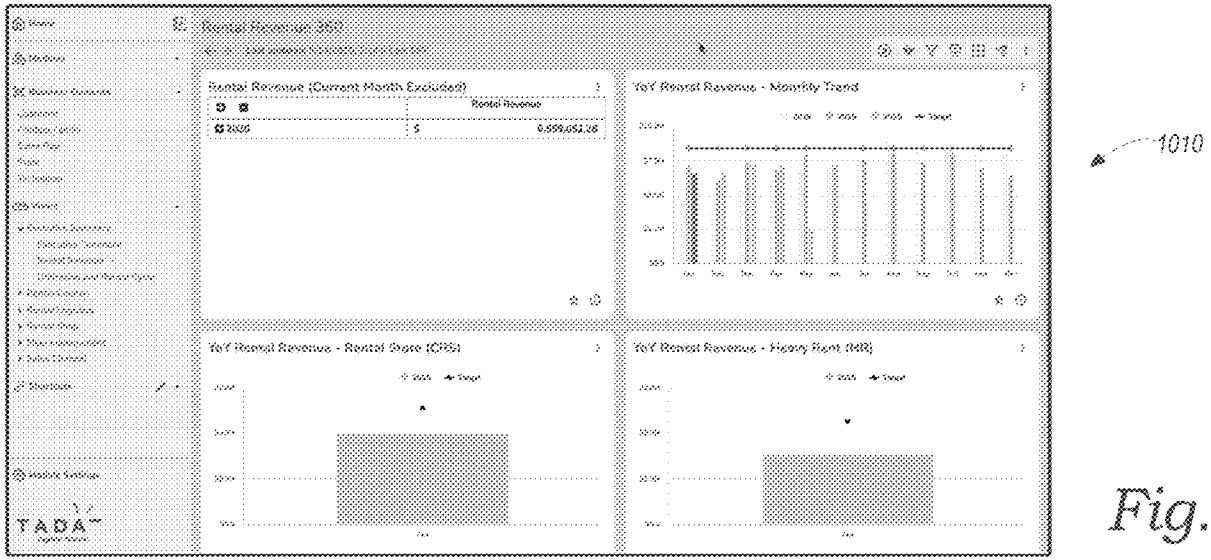
Figure 11A:
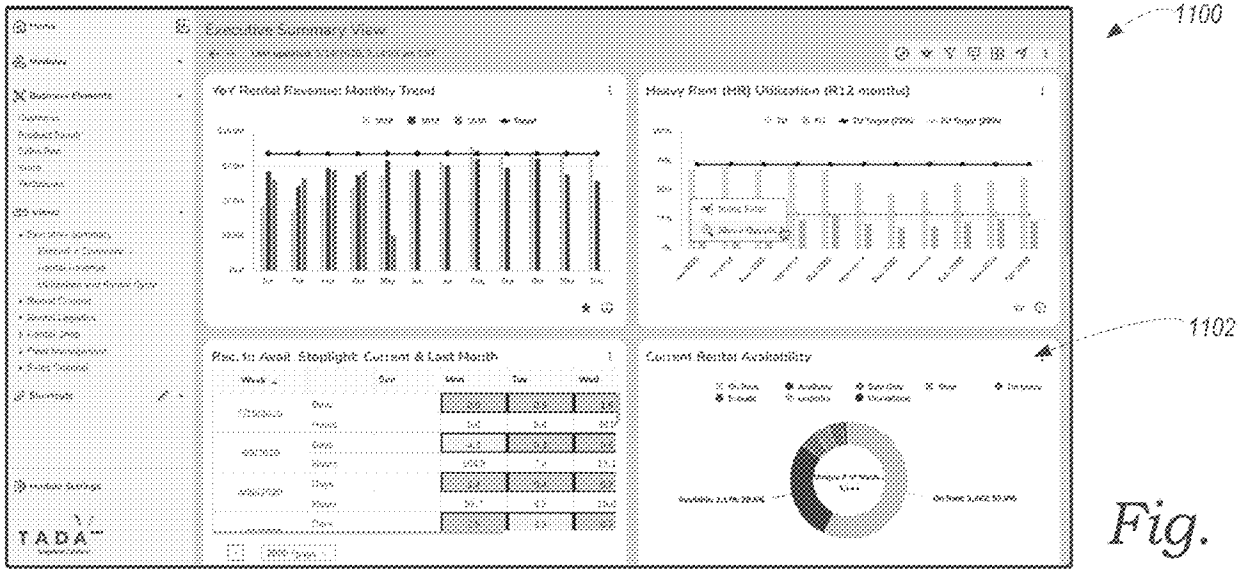
Figure 11B:
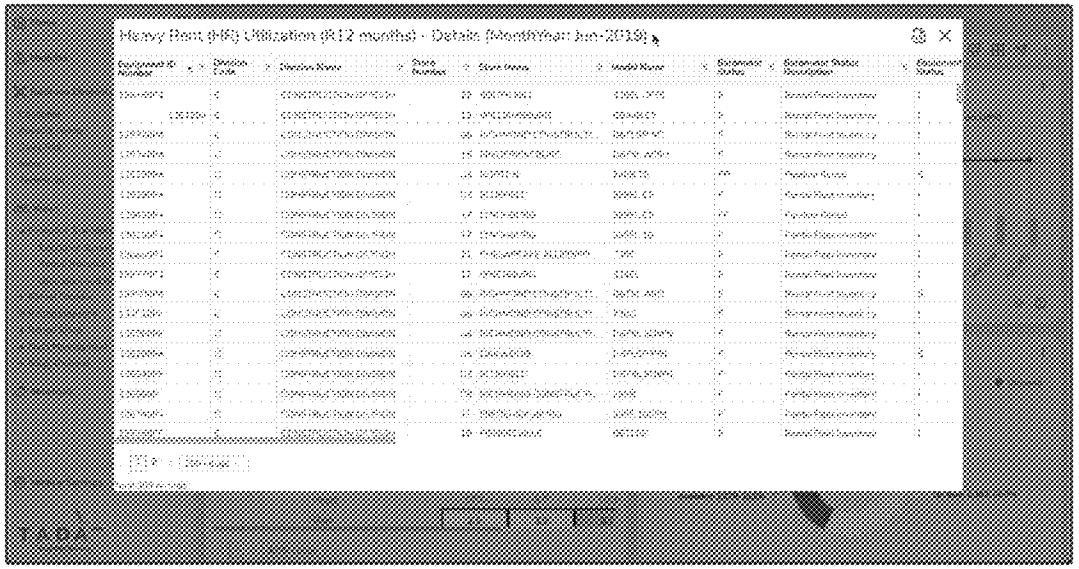
Figure 12A:
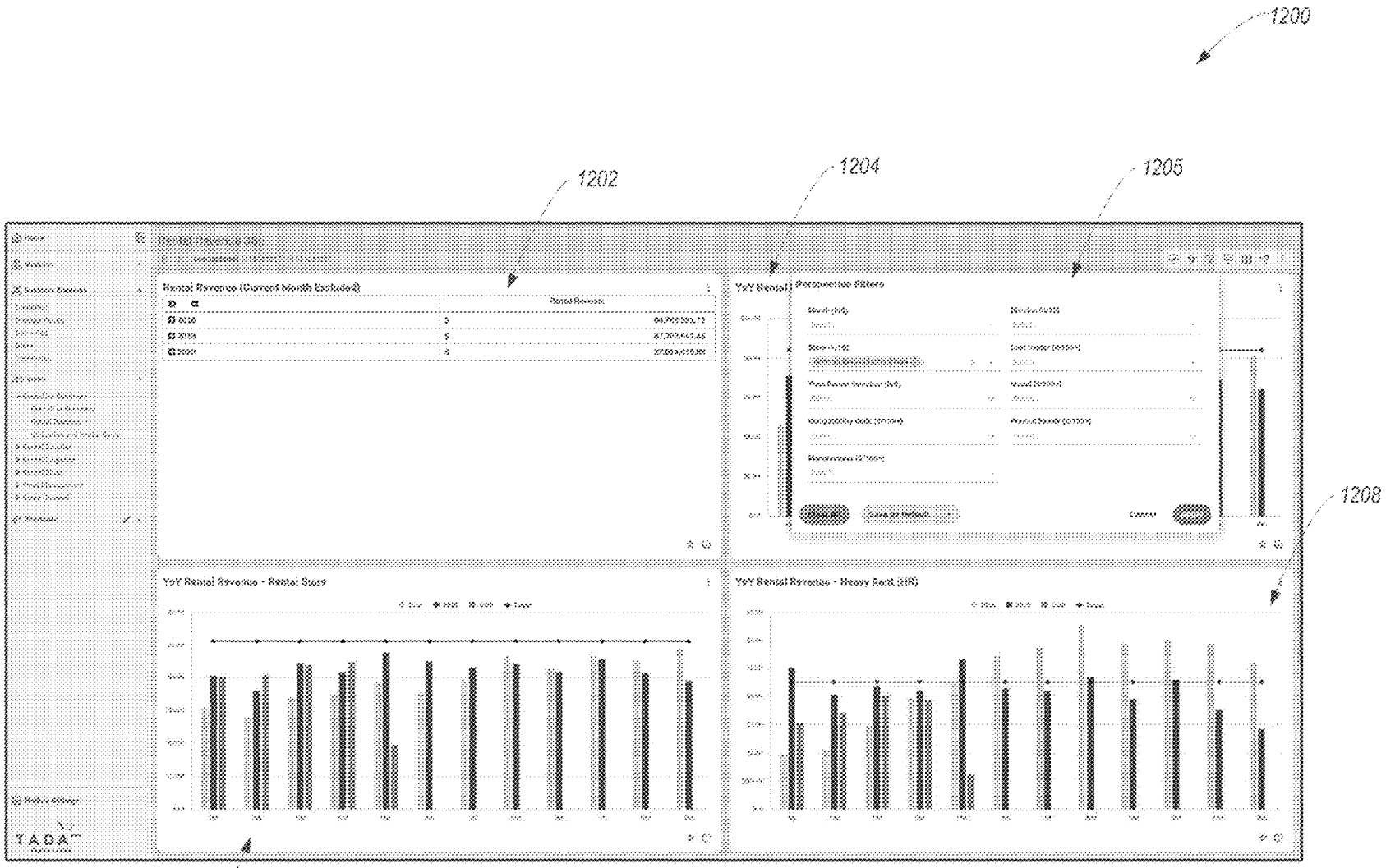
Figure 12B:
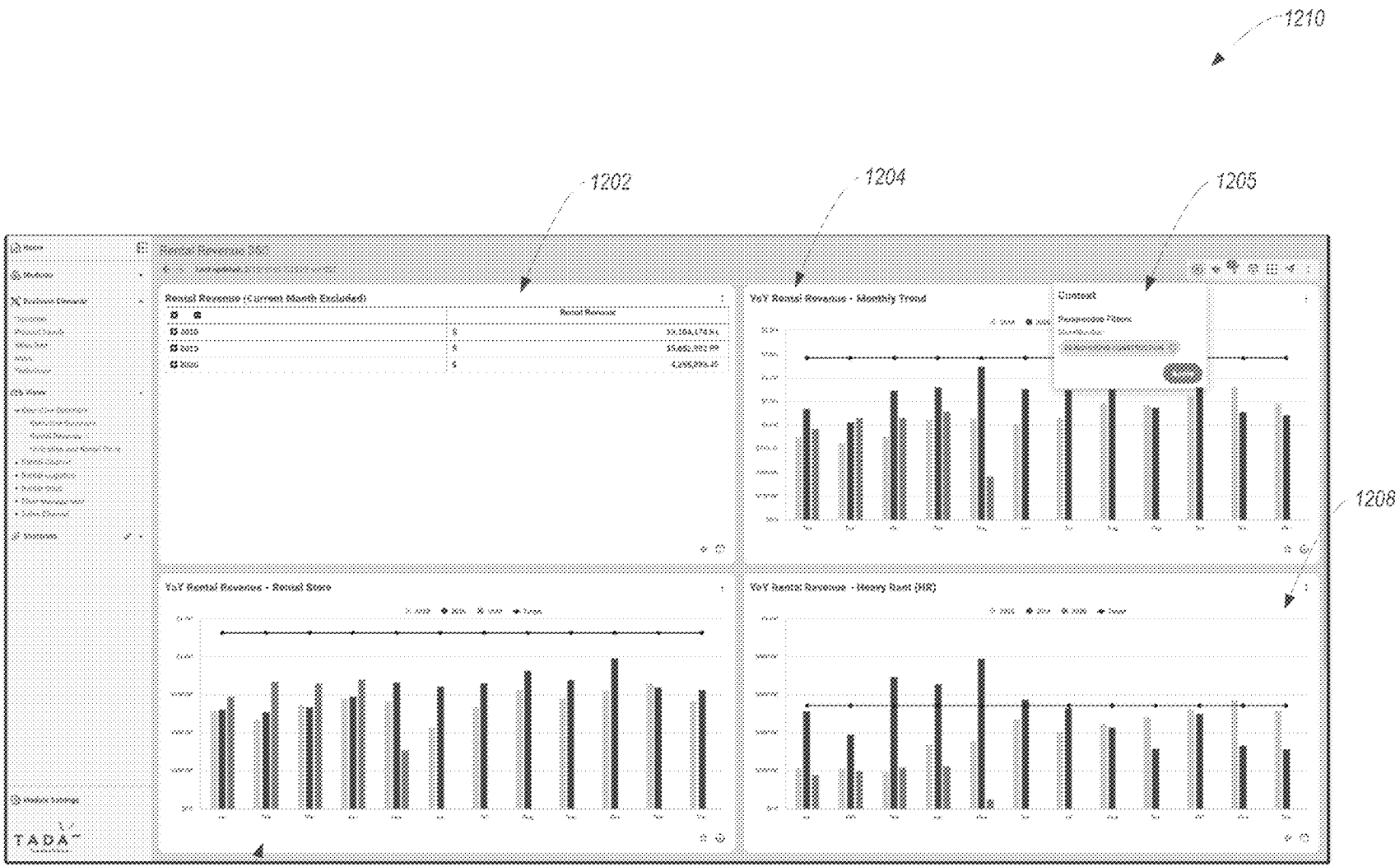

As shown in FIG. 2, a first end cap 16 and a second end cap 18 are located on opposing ends of the shell 12 of the muffler 10. The first end cap 16 and the second end cap 18 may be telescopically secured within the shell openings 56 of the shell first end 52 and the shell second end 54, respectively. The first end cap 16 and the second end cap 18 may include an end cap opening 21 (FIG. 4) defining a flange 20 extending axially relative to the shell longitudinal axis 15. The flange 20 of the end cap opening 21 is configured to be couplable to one of an inlet duct 22 or an outlet duct 24 (FIG. 7). The inlet duct 22 and the outlet duct 24 are shaped to be received on or within the flanged opening 20 of respective of the first end cap 16 and the second end cap 18. For example, one or both of the inlet duct 22 and the outlet duct 24 may be received on the flanged opening 20 of the first end cap 16 and the second end cap 18 with a band clamp 26.

Figure 4:
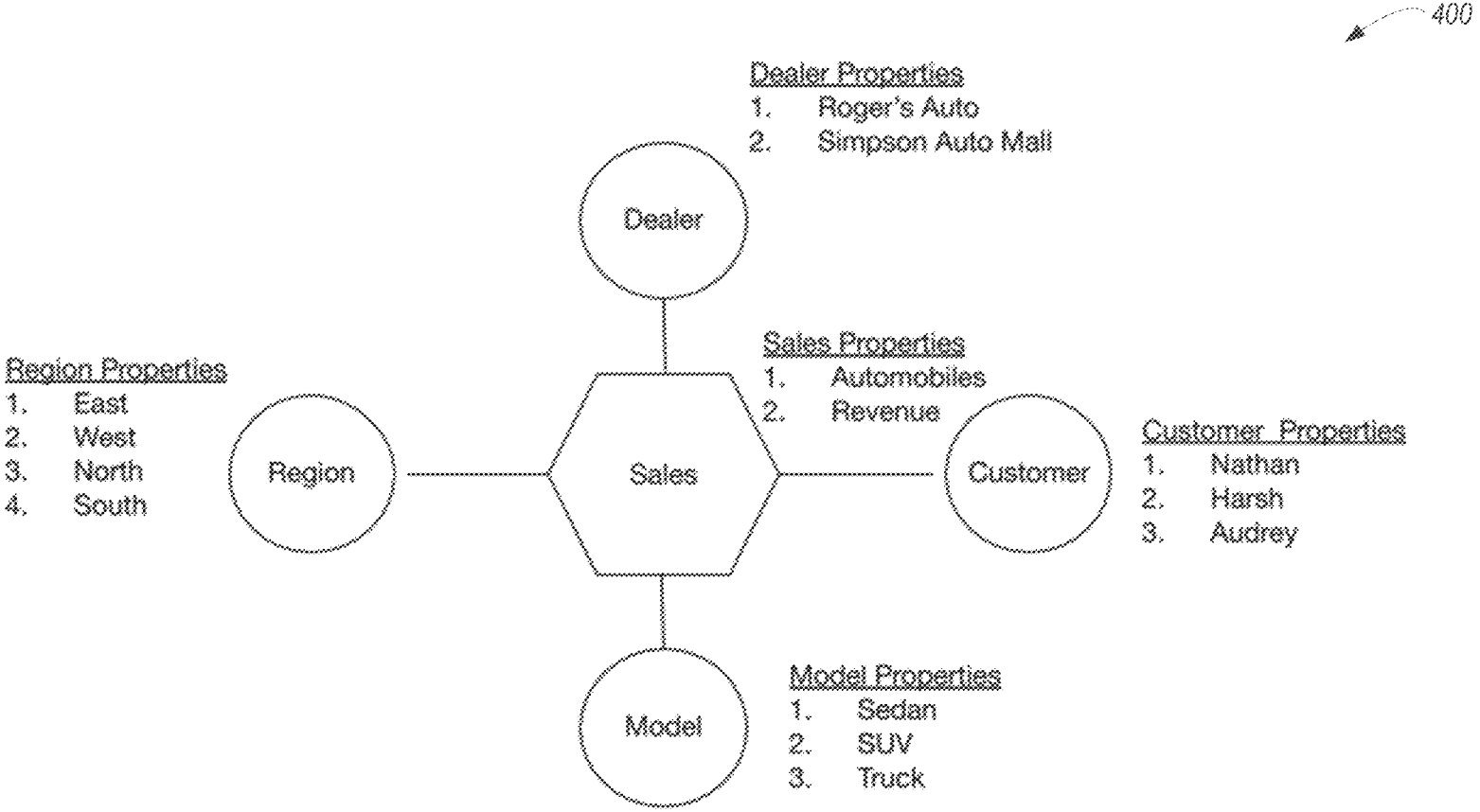
FIG. 4 shows a perspective view of a tube assembly of a muffler according to one aspect of the present disclosure.

Referring to FIG. 4, a tube assembly 28 is located within the shell cavity 13 of the shell 12 of the muffler 10. The tube assembly 28 includes a first collar 30 and a second collar 32 each defining a collar longitudinal axis 31, a collar first end 58, and a collar second end 60 opposite and spaced apart along the collar longitudinal axis 31 from the collar first end 58. The collar first end 58 defines a collar opening 38 extending to the collar second end 60.

The tube assembly 28 further includes a plurality of nested tubes 34. Each of the nested tubes 34 has a tube longitudinal axis 35 parallel to the shell longitudinal axis 15, a tube first end 62, and a tube second end 64 opposite and spaced apart along the tube longitudinal axis 35 from the tube first end 62. The tube first end 62 of each of the nested tubes 34 is disposed within the collar second end 60 of the first collar 30, and the tube second end 64 of each of the nested tubes 34 is disposed within the collar second end 60 of the second collar 32

Figure 5:
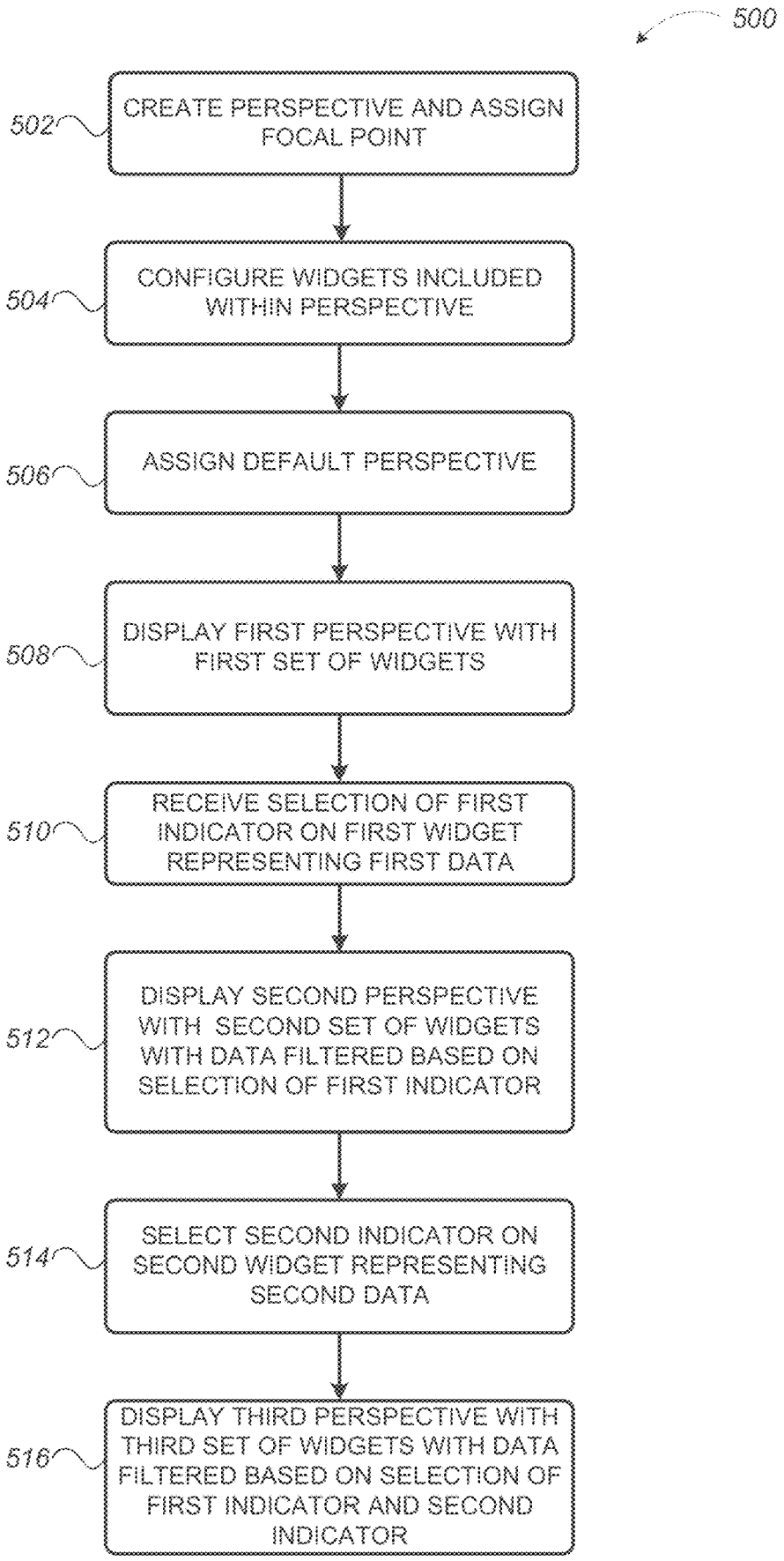
FIG. 5 shows an end view of a tube assembly of a muffler according to one aspect of the present disclosure.

The first collar 30 and the second collar 32 may be frustroconical such that a cross-sectional area of the collar opening 38 of the collar second end 60 as viewed in a plane perpendicular to the collar longitudinal axis 31 is greater than a cross-sectional area of the collar opening 38 of the collar first end 58 as viewed in a plane perpendicular to the collar longitudinal axis 31. The collar second end 60 of each of the first collar 30 and the second collar 32 is shaped to receive the nested tubes 34 in a substantially circular arrangement around the first collar 30 and the second collar 32. The first collar 30 and the second collar 32 may support the nested tubes 34 in a circular arrangement as shown in FIG. 5. Thus, the nested tubes 34 are disposed circumferentially adjacent each other around the shell longitudinal axis 15 such that portions of sides of the nested tubes 34 form an open portion 42 extending along the shell longitudinal axis 15.

Figures 6A, 6B:
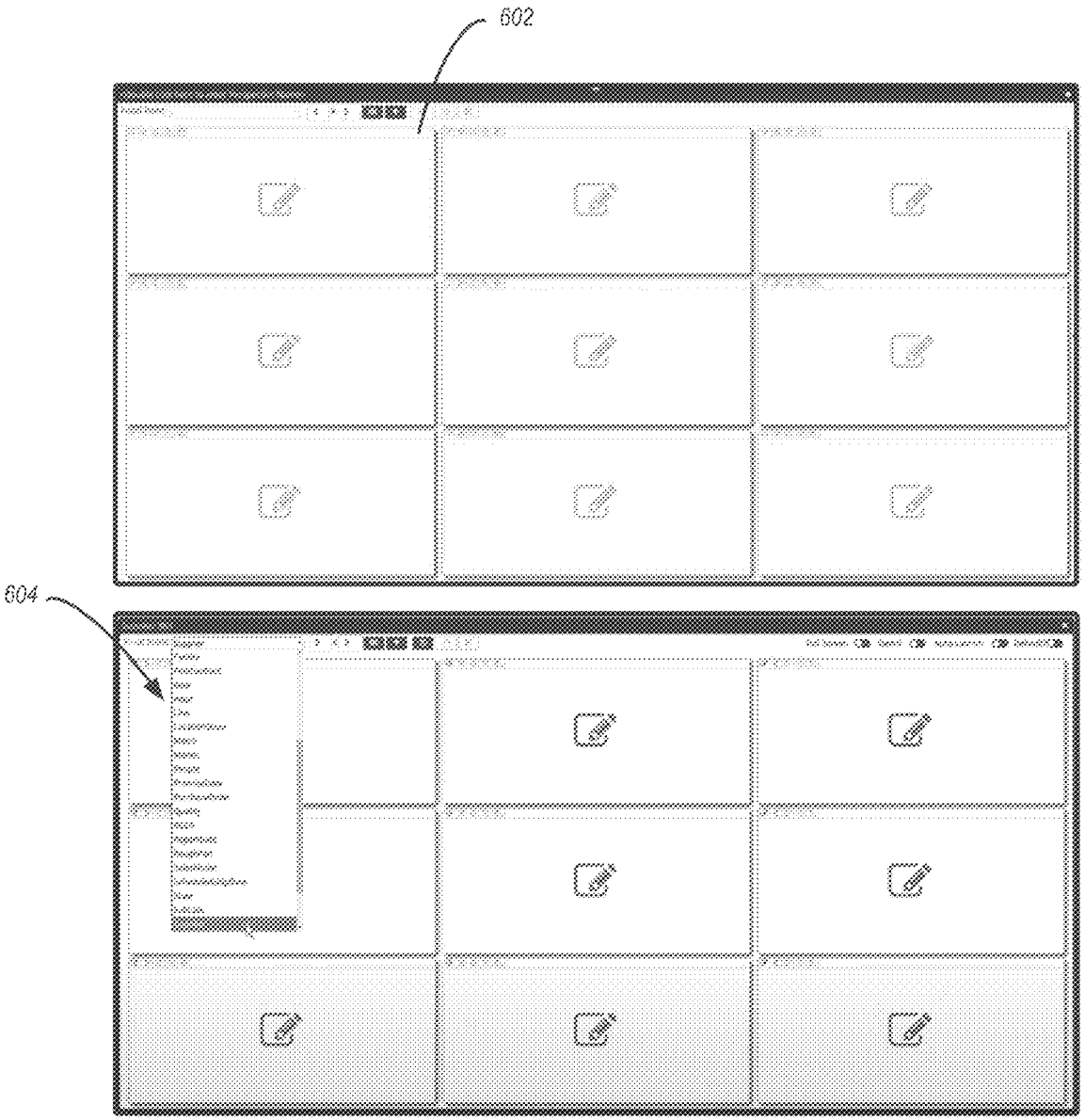
FIG. 6A shows a perspective view of a collar of a tube assembly according to one aspect of the present disclosure.
FIG. 6B shows an end view of a collar of a tube assembly according to one aspect of the present disclosure.

FIG. 6A and FIG. 6B show the first collar 30 with the second collar 32 being similar to or substantially the same as the first collar 30. The collar second end 60 of the first collar 30 and the second collar 32 may include a plurality of lobes 36 each having an arcuate cross-section as viewed in a place perpendicular to the collar longitudinal axis 31. The lobes 36 each have a radius of curvature corresponding to a radius of curvature of one of the nested tubes 34. Each of the nested tubes 34 is disposed within a different one of the lobes 36 to support opposing ends of the nested tubes 34. The nested tubes 34 may be supported in lateral contact to one another along lengths of the nested tubes 34. As shown in the figures, the first collar 30 and the second collar 32 may include six of the lobes 36 corresponding to six of the nested tubes 34 retained on the first collar 30 and the second collar 32.

The collar first end 58 of the first collar 30 and the second collar 32 may include a cylindrical shape that is sized such that the collar first end of the first collar is disposed within the end cap opening of the first end cap, and the first collar end of the second collar is disposed within the end cap opening of the second end cap.

Although the tube assembly 28 shown in FIGS. 1-7 includes six nested tubes 34, in some implementations, the tube assembly includes any number of three or more nested tubes and each of the first collar and the second collar define the same number of three or more lobes. In some implementations, the tube assembly includes five nested tubes and each of the first collar and the second collar define five lobes.

Referring to FIG. 5, the nested tubes 34 are arranged on the first collar 30 and the second collar 32 such that the nested tubes 34 are circularly arranged around an open portion 42 at a center of the tube assembly 28. The open portion 42 has a cross-sectional area corresponding to a space defined between inner sides of the nested tubes 34 of the tube assembly 28. The open portion 42 may extend along a length of the tube assembly 28 between the nested tubes 34 and may be substantially aligned with the collar longitudinal axis 31. The open portion 42 may form a center channel or conduit along a length of the tube assembly 28 to allow the flow of exhaust gases through a center of the tube assembly 28.

Referring to FIG. 4, the nested tubes 34 include a plurality of perforations 40 formed around the nested tubes 34. The perforations 40 may be formed around the nested tubes 34 along lengths of the nested tubes 34. The perforations 40 may be located substantially completely around the nested tubes 34 along lengths of the nested tubes 34 between the first collar 30 and the second collar 32 of the tube assembly 28.

In one aspect, the total area covered by the perforations 40 can range from about 5.0% to about 80% of the total surface area of each of the nested tubes 34. The total area covered by the perforations 40 may be from about 20% to about 40% of the total surface area of the nested tubes 34. A range of surface area of the nested tubes 34 covered by the perforations 40 may allow for variation of an amount of gas interconnection from the open portion 42 to the nested tubes 34, between the nested tubes 34, and from the nested tubes 34 to an interior volume of the muffler 10. In some implementations, the total area covered by the perforations 40 can be 100%.

Referring again to FIG. 2, a space in the shell cavity 13 between the shell 12 of the muffler 10 and the nested tubes 34 may be filled with a sound attenuating material 44. For example, the sound attenuating material 44 may include one or more of steel wool, fiberglass, and ceramic fiber. In some aspects, the space between the shell 12 of the muffler 10 and the nested tubes 34 may be hollow or may lack the sound attenuating material 44.

Referring now to FIG. 7, the muffler 10 may be part of an exhaust system 46 that may be used, for example, on a vehicle featuring an internal combustion engine. The exhaust system 46 may include a pair of the muffler 10 for receiving exhaust gases from a bank of cylinders of an internal combustion engines. Each of the muffler 10 may be located downstream of a forward muffler 48 such that exhaust gases first pass through the forward muffler 48 before reaching the muffler 10. Exhaust gases from the exhaust system 46 may exit through a pair of exhaust tips 50. The exhaust tips 50 may be oriented to emit exhaust gases from the exhaust system 46 from sides of a vehicle.

In operation, the exhaust gases flow from the inlet duct 22 into the first collar 30 where the exhaust gases are diffused or expanded to reduce temperature of exhaust gases and changing an acoustical frequency of sound waves within the first collar 30. A portion of the exhaust gases then flows into the nested tubes 34 where exhaust gases and acoustical pulses may move through the perforations 40 of the nested tubes 34 to attenuate exhaust sound waves. Portions of the exhaust sound waves may move through the perforations 40 into the sound attenuating material 44 when the muffler 10 includes sound attenuating material 44 within the shell 12 of the muffler 10. At least some of the exhaust sound waves may cancel each other to attenuate a sound of an exhaust system including the muffler 10. Other portions of the exhaust gases and sound waves may move through the open portion 42 at the center of the tube assembly 28, allowing portions of the exhaust gases to move through the tube assembly 28 substantially unobstructed by the nested tubes 34. The various exhaust gases and sound waves may then enter the second collar 32, where the sound waves and exhaust gases may be re-combined into a single flow through the outlet duct 24.

Aspects of the muffler 10 advantageously allow for a greater surface area over which exhaust gases may flow and allow for the frequencies in the exhaust to cancel each other out. Further, the open portion 42 located at the center of the muffler 10 allows for a portion of exhaust gases to effectively flow through the muffler 10 and reduce backpressure to enhance performance of an internal combustion engine.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A muffler comprising:

a shell defining a shell cavity, the shell having a shell longitudinal axis, a shell first end, and a shell second end opposite and spaced apart along the shell longitudinal axis from the shell first end, wherein the shell first end and the shell second end each define a shell opening extending to the shell cavity; and a tube assembly disposed within the shell cavity, the tube assembly including three or more nested tubes, each of the three or more nested tubes having a tube longitudinal axis parallel to the shell longitudinal axis, a tube first end, and a tube second end opposite and spaced apart along the tube longitudinal axis from the tube first end, wherein each of the three or more nested tubes defines a plurality of perforations, wherein the three or more nested tubes are circularly arranged around the shell longitudinal axis such that portions of sides of the three or more nested tubes form an open portion extending along the shell longitudinal axis, the open portion located at a center of the tube assembly, wherein the open portion is a geometric void defined solely by inwardly facing surfaces of the three or more nested tubes, the geometric void being unoccupied by any tube extending along the shell longitudinal axis.

2. The muffler of claim 1, wherein the tube assembly further includes a first collar and a second collar each defining a collar longitudinal axis, a collar first end, and a collar second end opposite and spaced apart along the collar longitudinal axis from the collar first end, wherein the collar first end defines a collar opening extending to the collar second end, wherein the tube first end of each of the three or more nested tubes are disposed within the collar second end of the first collar, and the tube second end of each of the three or more nested tubes are disposed within the collar second end of the second collar.

3. The muffler of claim 2, wherein the collar opening of the collar first end has a first cross-sectional area as viewed in a plane perpendicular to the collar longitudinal axis, and the collar opening of the collar second end has a second cross-sectional area as viewed in a plane perpendicular to the collar longitudinal axis, wherein the second cross-sectional area is greater than the first cross-sectional area.

4. The muffler of claim 2, wherein the collar first end has a cylindrical shape.

5. The muffler of claim 2, wherein the collar opening of the collar second end of the first collar and the second collar defines three or more lobes having an arcuate cross-section as viewed in a place perpendicular to the collar longitudinal axis, wherein each of the three or more nested tubes is disposed within a different one of the three or more lobes.

6. The muffler of claim 5, wherein the three or more lobes each have a radius of curvature corresponding to a radius of curvature of one of the three or more nested tubes.

7. The muffler of claim 2, further including a first end cap and a second end cap, wherein each of the first end cap and the second end cap defines an end cap opening, wherein the first end cap is disposed within the shell opening of the shell first end, and the second end cap is disposed within the shell opening of the shell second end.

8. The muffler of claim 7, wherein the collar first end of the first collar is disposed within the end cap opening of the first end cap, and the first collar end of the second collar is disposed within the end cap opening of the second end cap.

9. The muffler of claim 7, wherein the end cap opening defines a flange extending axially relative to the shell longitudinal axis.

10. The muffler of claim 9, wherein the flange of the end cap opening is configured to be couplable to one of an inlet duct or an outlet duct of an exhaust system.

11. The muffler of claim 1, wherein the three or more nested tubes comprises five or more nested tubes.

12. The muffler of claim 11, wherein the five or more nested tubes comprises six or more nested tubes.

13. The muffler of claim 1, wherein each of the three or more nested tubes has an outer surface, wherein the plurality of perforations are located on a portion of the outer surface covering 5% to 80% of each of the three or more nested tubes.

14. The muffler of claim 13, wherein the portion of the outer surface covers 20% to 40% of each of the three or more nested tubes.

15. The muffler of claim 1, wherein the plurality of perforations are located substantially completely around each of the three or more nested tubes.

16. The muffler of claim 1, wherein the shell has an oval cross-sectional shape as viewed in a plane perpendicular to the shell longitudinal axis.

17. The muffler of claim 1, further comprising a sound attenuating material disposed within the shell cavity between the three or more nested tubes and the shell.

18. The muffler of claim 17, wherein the sound attenuating material comprises steel wool.

19. The muffler of claim 17, wherein the sound attenuating material comprises fiberglass.

20. The muffler of claim 17, wherein the sound attenuating material comprises ceramic fiber.

* * * * *